US011781498B2

(12) United States Patent
McIntier et al.

(10) Patent No.: US 11,781,498 B2
(45) Date of Patent: Oct. 10, 2023

(54) CONTROLS FOR BREAK-IN OPERATION OF GREEN ENGINES

(71) Applicant: Cummins Inc., Columbus, IN (US)

(72) Inventors: Rebekah Lippis McIntier, Columbus, IN (US); John D. Ridge, Indianapolis, IN (US); Daniel Christopher Villiger, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/664,737

(22) Filed: May 24, 2022

(65) Prior Publication Data

US 2022/0282680 A1 Sep. 8, 2022

Related U.S. Application Data

(63) Continuation of application No. PCT/US2020/060324, filed on Nov. 13, 2020.

(60) Provisional application No. 62/940,398, filed on Nov. 26, 2019.

(51) Int. Cl.
*F02D 41/04* (2006.01)

(52) U.S. Cl.
CPC ..... *F02D 41/04* (2013.01); *F02D 2250/26* (2013.01)

(58) Field of Classification Search
CPC ..... F02D 41/04; F02D 2250/26
USPC ..... 123/1 R
See application file for complete search history.

(56) References Cited

U.S. PATENT DOCUMENTS

| | | | |
|---|---|---|---|
| 5,241,855 | A | 9/1993 | Cullen et al. |
| 6,044,822 | A | 4/2000 | Daniels |
| 6,098,587 | A | 8/2000 | Malss et al. |
| 6,584,391 | B2 | 6/2003 | Lack |
| 6,964,258 | B2 | 11/2005 | Gudgeon et al. |
| 9,080,617 | B2 | 7/2015 | Reibold et al. |
| 9,429,082 | B2 | 8/2016 | Holthaus et al. |
| 2005/0092290 | A1 | 5/2005 | Gudgeon et al. |
| 2006/0116806 | A1 | 6/2006 | Steen et al. |
| 2009/0037073 | A1 | 2/2009 | Jung et al. |
| 2009/0139320 | A1* | 6/2009 | Bulgrien ..... F16H 61/0213 701/64 |
| 2016/0146127 | A1 | 5/2016 | Glugla |

FOREIGN PATENT DOCUMENTS

| | | |
|---|---|---|
| DE | 102005026469 | 1/2006 |
| DE | 102008018156 | 11/2008 |
| DE | 102013020939 | 6/2015 |
| WO | 2009156318 | 12/2009 |
| WO | 2017081657 | 5/2017 |

OTHER PUBLICATIONS

International Search Report and Written Opinion, PCT Appln. Serial No. PCT/US20/060324, dated Feb. 25, 2021, 11 pgs.

* cited by examiner

*Primary Examiner* — Mahmoud Gimie

(74) *Attorney, Agent, or Firm* — Taft Stettinius & Hollister LLP

(57) ABSTRACT

An electronic control system configured to control operation of an engine by evaluating whether to operate the engine in a green engine break-in mode. In the green engine break-in mode, the electronic control system is configured to determine a break-in torque limit for the engine, dynamically vary the break-in torque limit in response to break-in operation of the engine, and control operation of the engine using dynamically modified break-in torque limit.

30 Claims, 6 Drawing Sheets

CONTROLS FOR BREAK-IN OPERATION OF GREEN ENGINES

CROSS-REFERENCE

The present application is a continuation of continuation of International Application No. PCT/US2020/060324 filed Nov. 13, 2020 which claims priority to and the benefit of U.S. Application No. 62/940,398 filed Nov. 26, 2020, the disclosures of which are hereby incorporated by reference.

BACKGROUND

The present application relates generally to controls for break-in operation of green engines, i.e., engines that are newly installed or commissioned or which have been operated for a limited, if any, duration. Green engine growth is a phenomenon in which an engine may exhibit changes in its operation and its response to control and physical inputs during an initial break-in period or duration of engine operation. A variety of such changes may occur and such changes may be specific to particular engine designs or models and may be further specific to individual engines. Such changes may be subtle and are not necessarily disadvantageous. Even so, it may be desirable to limit the effects of green engine growth to mitigate or minimize variation in operation and response to control and physical inputs. Present approaches to engine control leave a significant unmet need for the unique apparatuses, controls, methods, systems, and techniques disclosed herein.

DISCLOSURE OF ILLUSTRATIVE EMBODIMENTS

For the purposes of clearly, concisely, and exactly describing illustrative embodiments of the present disclosure, the manner, and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created and that the invention includes and protects such alterations, modifications, and further applications of the exemplary embodiments as would occur to one skilled in the art.

SUMMARY OF THE DISCLOSURE

One embodiment is a unique method including operation of a green engine in a break-in mode. Further embodiments, forms, objects, features, advantages, aspects, and benefits shall become apparent from the following description and drawings.

DETAILED DESCRIPTION OF ILLUSTRATIVE EMBODIMENTS

Figure 1:
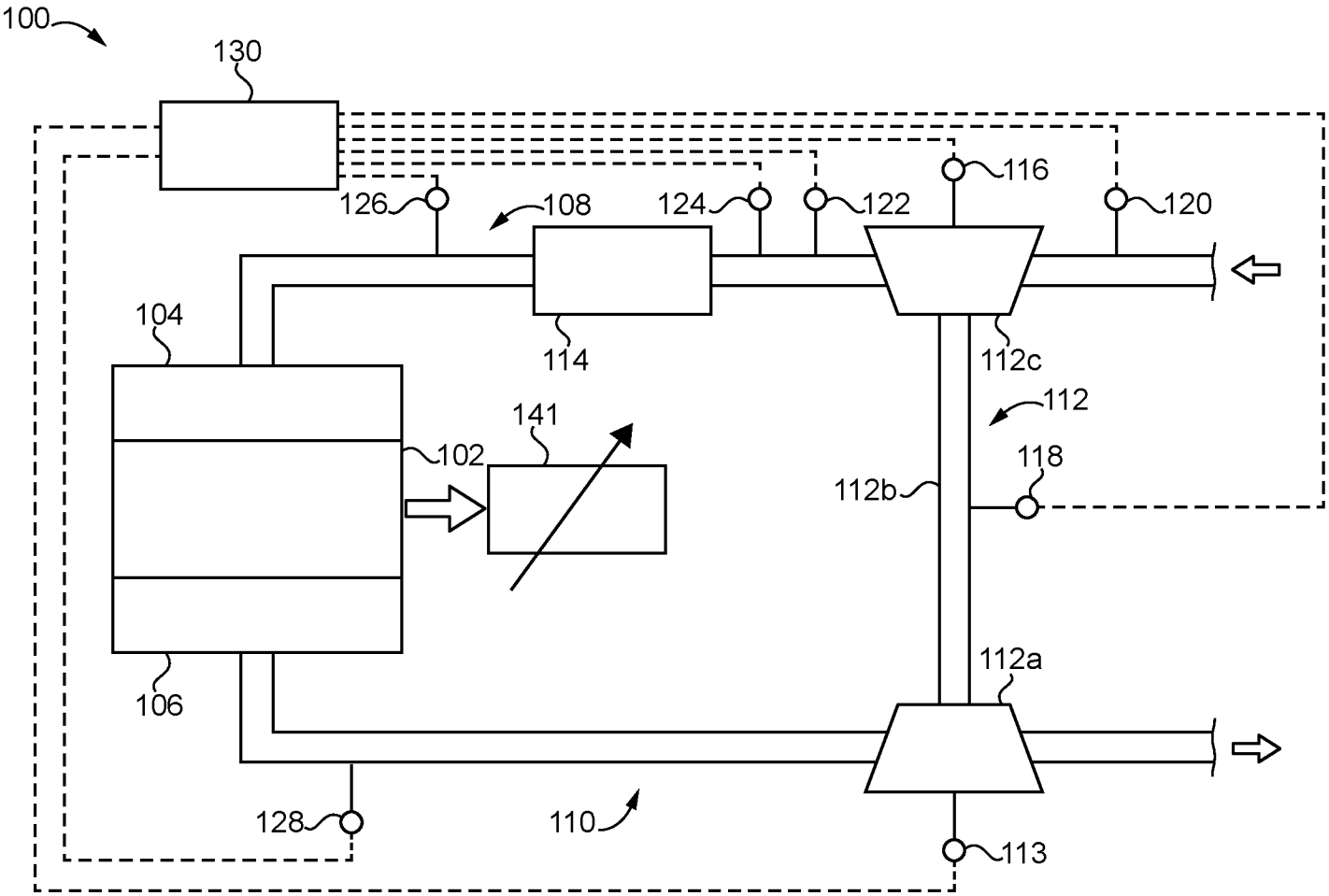
FIG. 1 is a schematic diagram illustrating certain aspects of an example engine system.

With reference to FIG. 1, there is illustrated a schematic view of an example engine system 100 including an engine 102, such as an internal combustion engine or a combination of an internal combustion and other prime mover components. In the illustrated embodiment, engine 102 is a green engine, i.e., an engine which has been newly installed or commissioned or which has been operated, it at all, for a limited duration. Such a limited duration may be, for example, a testing duration, a testing and delivery duration, or another limited duration wherein the engine's tolerances, dimensions, and operation are in an initial dynamic state prior to achieving a steady-state or substantially constant post-initial state. Engine 102 is structured to output torque to drive a load 141. Engine 102 may be provided in a variety of industrial machine systems including, for example, off-highway work machines such as excavators, loaders and mining haul trucks, on-highway vehicle systems, hydraulic pumping systems, pneumatic systems, and power generation systems. It shall be further appreciated that the illustrated embodiment of the engine system 100 is but one example of an engine system contemplated by the present disclosure and that a variety of other engine systems including additional or alternate components and features as well as other engine systems not including one or more of the features of the illustrated embodiment are contemplated.

In the illustrated embodiment, the engine system 100 includes a turbocharger 112 operatively coupled with an intake system 108 and an exhaust system 110 of engine 102. The engine 102 is in fluid communication with the intake system 108 through which charge air enters an intake manifold 104 of the engine 102 and is also in fluid communication with the exhaust system 110, through which exhaust gas resulting from combustion exits by way of an exhaust manifold 106 of the engine 102, it being understood that not all details of these systems are shown. The engine 102 includes a number of cylinders forming combustion chambers into which fuel is injected by fuel injectors to combust with the charge air that has entered through intake manifold 104. The energy released by combustion powers the engine 102 via pistons connected to a crankshaft. Intake valves control the admission of charge air into the cylinders, and exhaust valves control the outflow of exhaust gas through exhaust manifold 106 and ultimately to the atmosphere.

The turbocharger 112 is operable to compress ambient air before the ambient air enters the intake manifold 104 of the engine 102 at increased pressure. It is contemplated that in the engine system 100 including the turbocharger 112, the turbocharger 112 may include a variable geometry turbocharger (VGTs), fixed geometry turbocharger, twin-turbochargers, and/or series or parallel configurations of multiple turbochargers, as well as other turbocharger or supercharger systems, devices and configurations. The illustrated turbocharger 112 includes a bearing housing 112*b* for housing bearings and a shaft connecting a turbine 112*a* coupled to the exhaust system 110 with a compressor 112*c* coupled to the intake system 108. The air from the compressor 112*c* is pumped through the intake system 108, to the intake manifold 104, and into the cylinders of the engine 102, typically producing torque on the crankshaft.

The intake system 108 includes a charge aftercooler (CAC) 114 operable to cool the charge flow provided to the intake manifold 104. It is contemplated that in certain embodiments the CAC 114 may include charge air cooler bypass values, or that the CAC 114 may not be present altogether. The intake system 108 and/or the exhaust system 110 may further include various components not shown, such as coolers, valves, bypasses, an exhaust gas recirculation (EGR) system, intake throttle valves, exhaust throttle valves, EGR valves, and/or compressor bypass valves, for example.

The engine system 100 further includes a controller 130 structured to perform certain operations and to receive and interpret signals from any component and/or sensor of the engine system 100. It shall be appreciated that the controller 130 may be provided in a variety of forms and configurations including one or more computing devices forming a whole or a part of a processing subsystem having non-transitory memory storing computer-executable instructions, processing, and communication hardware. The controller 130 may be a single device or a distributed device, and the functions of the controller 130 may be performed by hardware or software. The controller 130 is in communication with any actuators, sensors, datalinks, computing devices, wireless connections, or other devices to be able to perform any described operations.

The processing logic may be implemented by software, hardware, artificial intelligence, fuzzy logic, or any combination thereof, or at least partially performed by a user or operator. In certain embodiments, one or more components of the processing logic may be provided as software elements of a computer program stored or encoded on a non-transitory computer-readable medium, wherein a computer performs the described operations when executing the computer program. The processing logic may be implemented in a single device, distributed across devices, and/or may be grouped in whole or in part with other devices. The operations of different portions of the processing logic may be performed wholly or partially in a variety of hardware or software components or structures.

The controller 130 includes stored data values, constants, and functions, as well as operating instructions stored on a computer-readable medium. Any of the operations of exemplary procedures described herein may be performed at least partially by the controller. Other groupings that execute similar overall operations are understood within the scope of the present application. More specific descriptions of certain embodiments of the controller 130 operations are discussed herein in connection with FIG. 2. Operations illustrated are understood to be exemplary only, and operations may be combined or divided, and added or removed, as well as re-ordered in whole or in part.

The engine system 100 includes a turbine housing temperature sensor 113, a compressor housing temperature sensor 116, and a bearing housing temperature sensor 118, each operable to provide a signal to the controller 130 indicating the temperature of each of the respective housings of the turbocharger 112. The engine system 100 additionally includes a mass airflow (MAF) sensor 120, an ambient air temperature sensor 122, an ambient air pressure sensor 124, and an intake pressure sensor 126, each in fluid communication with the intake system 108. The engine system 100 further includes an exhaust temperature sensor 128 in fluid communication with the exhaust system 110. The sensors described herein need not be in direct communication with the intake system 108 or the exhaust system 110 and can be located at any position within the intake system 108 or the exhaust system 110 that provides a suitable indication of applicable intake system 108 and exhaust system 110 readings.

It shall be appreciated that the foregoing sensors and sensor arrangements are but several non-limiting, illustrative embodiments of sensors and sensor systems to which the principles and techniques disclosed herein may be applied. A variety of other types of sensors and sensor configurations may be utilized including coolant temperature sensors, oil temperature sensors, EGR flow sensors, boost pressure sensors, and/or exhaust temperature sensors to name but a few examples. It shall further be appreciated that the sensors which are utilized may be physical sensors, virtual sensors, and/or combinations thereof.

The controller 130 is operatively coupled with and configured to store instructions in memory which are readable and executable by the controller 130 to control operation of engine 102 as described herein. Certain operations described herein include operations to determine one or more parameters. Determining, as utilized herein, includes calculating or computing a value, obtaining a value from a lookup table or using a lookup operation, receiving values from a datalink or network communication, receiving an electronic signal (e.g., a voltage, frequency, current, or pulse-width modulation (PWM) signal) indicative of the value, receiving a software parameter indicative of the value, reading the value from a memory location on a computer-readable medium, receiving the value as a run-time parameter by any means known in the art, and/or by receiving a value by which the interpreted parameter can be calculated, and/or by referencing a default value that is interpreted to be the parameter value.

Controller 130 is one example of a component of an integrated circuit-based electronic control system (ECS) which may be configured to control various operational aspects of the engine system 100 and powertrain 102 of a vehicle as described in further detail herein. An ECS according to the present disclosure may be implemented in a number of forms and may include a number of different elements and configurations of elements. In certain forms, an ECS may incorporate one or more microprocessor-based or microcontroller-based electronic control units sometimes referred to as electronic control modules. An ECS according to the present disclosure may be provided in forms having a single processing or computing component, or in forms comprising a plurality of operatively coupled processing or computing components; and may comprise digital circuitry, analog circuitry, or a hybrid combination of both of these types. The integrated circuitry of an ECS and/or any of its constituent processors/controllers or other components may include one or more signal conditioners, modulators, demodulators, arithmetic logic units (ALUs), central processing units (CPUs), limiters, oscillators, control clocks, amplifiers, signal conditioners, filters, format converters, communication ports, clamps, delay devices, memory devices, analog to digital (A/D) converters, digital to analog (D/A) converters, and/or different circuitry or functional components as would occur to those skilled in the art to provide and perform the communication and control aspects disclosed herein.

Figure 2:
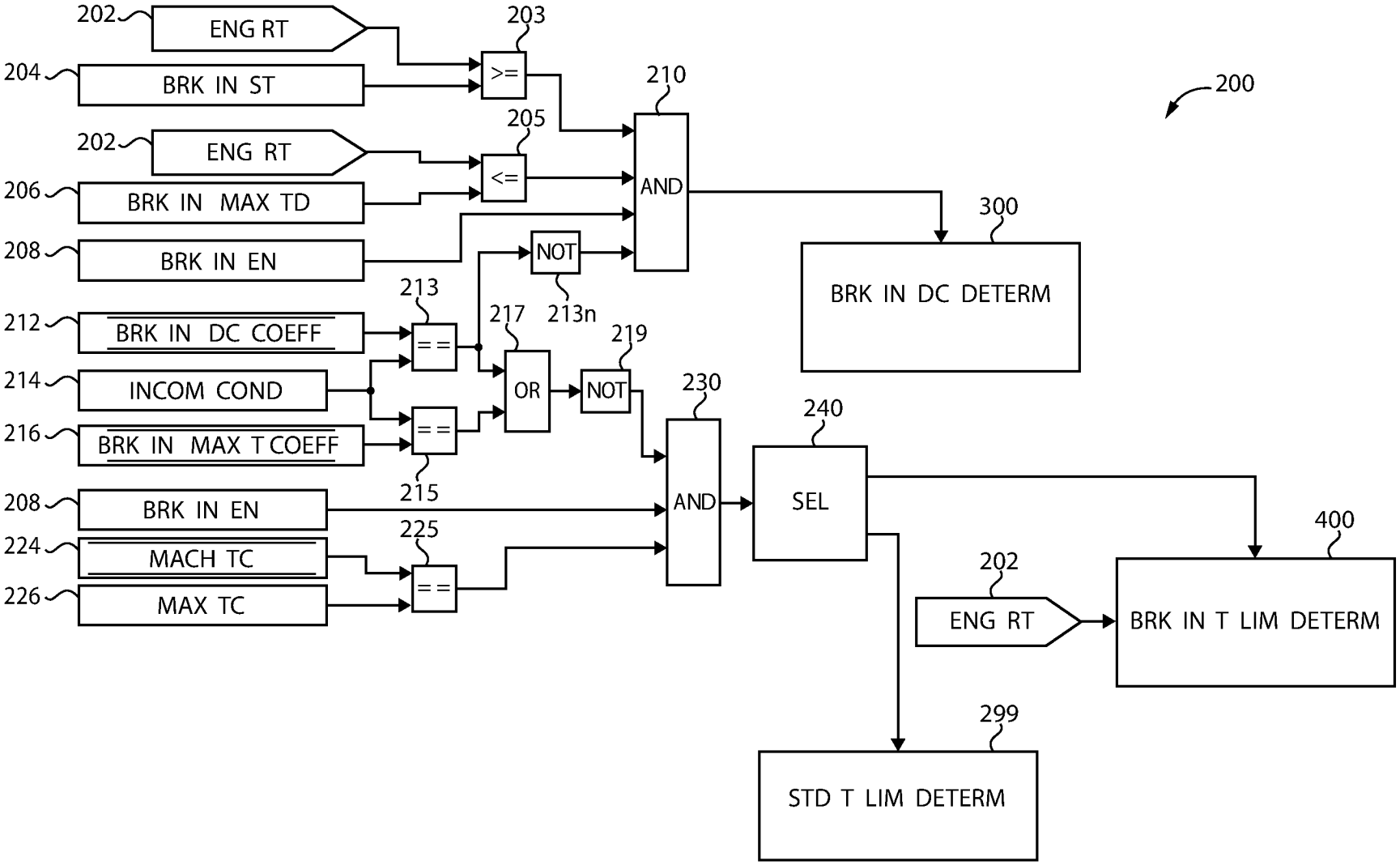
FIG. 2 is a schematic diagram illustrating certain aspects of example controls which may be implemented in and executed by one or more components of an electronic control system for an engine system.

With reference to FIG. 2, there are illustrated certain aspects of example controls 200 which may be implemented in and executed by one or more components of an ECS in operative communication with an engine, such as controller 130 and/or other ECS components and systems. In describing controls 200 as well as the other controls disclosed herein, including those illustrated and described in connection with FIGS. 3-6, reference is made to logical operators such as logical AND, logical OR, or logical NOT. It shall be appreciated that alternative logical operators providing the same net logical determinations may also be utilized. To take one simple example, a logical AND operator in series with a logical NOT operator may alternatively be provided as a logical NAND operator. It shall be further appreciated that logical operators according to the present disclosure may be implemented in and include and encompass logic circuitry, executable instructions stored in non-transitory memory media, and combinations thereof. In such description, reference is also made to comparison operations such as "greater than" or "greater than or equal to" which shall be understood to be mutually inclusive and readily implementable in either form by adjustment of a threshold value to include or to be computationally above or below a defined threshold. In such description reference is also made to "true" and "false" logical states which shall be understood to include alternative nomenclatures such as "true" and "not true," "1" and "0," and "high" and "low" to name several examples.

Operator 203 receives as input an engine run time 202 and a break-in start time 204, evaluates whether engine run time 202 is greater than or equal to break-in start time 204, and outputs the result of this evaluation (true or false) to logical AND operator 210. Engine run time 202 may be a running total of the time that an engine has been running and may be tracked and updated by a component of an ECS associated with a given engine. Break-in start time 204 may be a predetermined time configured to account for operation of the engine that will occur as part of the manufacturing and commissioning processes at the factory and may be selected to delay entry to enter a green engine break-in mode until after completion of these processes. By evaluating whether engine run time 202 is greater than or equal to break-in start time 204, operator 203 tests one of several conditions which must be true in order for logical AND operator 210 to output true and initiate or trigger break-in duty cycle determination controls 300.

Operator 205 receives as input engine run time 202 and break-in maximum timeout 206, evaluates whether engine run time 202 is less than or equal to break-in maximum timeout 206, and outputs the result of this evaluation (true or false) to operator 210. Break-in maximum timeout 206 may be a predetermined time established as a limit on the duration of engine run time during which a green engine break-in operation is permitted. By evaluating whether engine run time 202 is less than or equal to break-in maximum timeout 206, operator 203 tests one of several conditions which must be true in order for logical AND operator 210 to output true and initiate or trigger break-in duty cycle determination controls 300.

Operator 213 receives as input machine break-in duty cycle coefficient 212 and incompatibility condition 214, evaluates whether machine break-in duty cycle coefficient 212 is equal to incompatibility condition 214, and outputs the result of this evaluation (true or false) to logical OR operator 217 and logical NOT operator **213*n*. Logical NOT operator outputs the logical inverse of its received input (true output in response to false input and vice versa) to logical AND operator 210**.

As described above, logical AND operator 210 receives the output of operators 203, 205, and **213*n*, and also receives break-in enable 208 as input. If each of the received inputs are true, logical AND operator 210 provides a true output effective to initiate or trigger break-in duty cycle determination controls 300 which are further described in connection with FIG. 3. If any of the received inputs are false, logical AND operator 210 provides a false output which does not initiate or trigger break-in duty cycle determination controls 300**.

Operator 215 receives as input incompatibility condition 214 and machine break-in maximum time coefficient 216, evaluates whether incompatibility condition 214 is equal machine break-in maximum time coefficient 216 and outputs the result of this evaluation (true or false) to logical OR operator 217 which, in turn, outputs to logical NOT operator 219. The output of logical NOT operator 219 is provided as an input to logical AND operator 230 which will be true if the value of each of operators 213 and 215 is false and will be false if the value of either of operators 213 and 215 is true. Machine break-in duty cycle coefficient 212 and machine break-in maximum time coefficient 216 are coefficients which are determined and utilized in break-in engine controls as further described in connection with FIGS. 5 and 6 below. Thus, it shall be appreciated the output provided by logical NOT operator is effective to indicate whether either machine break-in duty cycle coefficient 212 or machine break-in maximum time coefficient 216 is evaluated to be incompatible with a given engine or ECS.

Operator 225 receives as input machine current torque curve 224 and maximum torque curve 226, evaluates whether these inputs are equal to one another and provides a true or false output to logical AND operator 230 which also receives the output of logical NOT operator 219 and break-in enable 208. If each of the received inputs are true, logical AND operator 230 provides a true output effective cause selection operator 240 to enable or initiate break-in torque limit determination controls 400 which are further described in connection with FIG. 4 and which also receive engine run time 202. If any of the received inputs is false, logical AND operator 230 provides a false output effective cause selection operator 240 to enable or initiate default or standard torque limit determination 299 rather than break-in torque limit determination controls 400.

It shall be appreciated that controls 200 provide one example of controls operable to evaluate whether to operate an engine in a green engine break-in mode and to selectably control operation of the engine in the green engine break-in mode or in a non-break-in mode. In one respect, controls 200 provide one example of such controls include providing a predetermined threshold corresponding to an engine run time. In another respect, controls 200 provide one example of such controls in which the engine operates in a first non-break-in mode when the engine operates below the predetermined threshold. In a further respect, controls 200 provide one example of such controls in which the engine operates in the green engine break-in mode when the engine operates above the predetermined threshold. In an additional respect, controls 200 provide one example of such controls wherein the engine operates in a second non-break-in mode after the engine has been running in the green engine break-in mode longer than a predetermined time for operating in the green engine break-in mode.

Figure 3:
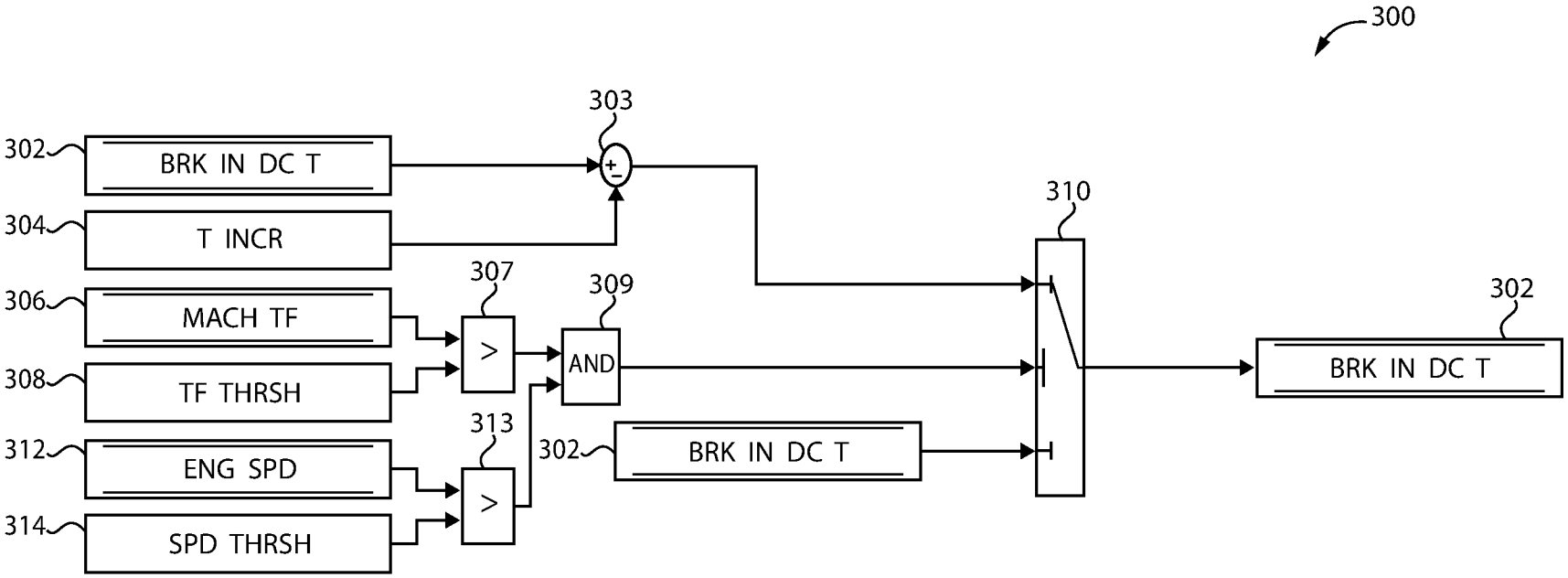
FIG. 3 is a schematic diagram illustrating certain aspects of example controls which may be implemented in and executed by one or more components of an electronic control system for an engine system.

With reference to FIG. 3, there are illustrated certain aspects of example controls 300 which may be implemented in and executed by one or more components of an ECS in operative communication with an engine, such as controller 130 and/or other ECS components and systems. Controls 300 are configured and operable to determine and update a break-in engine break-in duty cycle time 302 which is utilized in break-in operation of an engine such as engine 102 of engine system 100 or another engine or engine system. In general, controls 300 are configured and operable to determine or count how long the engine is running in a green engine break-in mode. It shall be appreciated that the current value of green engine break-in duty cycle time 302 is both an input to an output of controls 300, the input being the current value of green engine break-in duty cycle time 302 at a given operating point or time (t), and the output being an updated and potentially incremented value of green engine break-in duty cycle time 302 at a subsequent operating point or time (t+1).

Logical operator 303 receives as input green engine break-in duty cycle time 302 and time increment 304 and outputs the additive sum of the received input values to a first input of selection operator 310. Accordingly, the value provided to the first input of selection operator 310 may be considered an incremented value of green engine break-in duty cycle time 302. The second input of selection operator 310 receives a current non-incremented value of green engine break-in duty cycle time 302. Selection operator 310 is will output the value of either its first input or its second input as an updated value of green engine break-in duty cycle time 302 depending on the value provided to its third input by logical AND operator 309.

Logical operator 307 receives as inputs machine total fueling 306 and break-in total fueling threshold 308, evaluates whether machine total fueling 306 is greater than break-in total fueling threshold 308, and provides an output of either true or false to an input of logical AND operator 309. Machine total fueling 306 may be a value indicating the total fueling that is provided to an engine, such as engine 102 of engine system 100 or another engine or system, at a given operating point or over a given operating period. Break-in total fueling threshold 308 may be a predetermined value established to set a minimum fueling below which the engine is not considered to be operating in a green engine break-in mode. Thus, logical operator 307 may be considered to make a determination of whether a machine total fueling (e.g., the actual total fueling) is greater than a threshold.

Logical operator 313 receives as inputs engine speed 312 and break-in engine speed threshold 314, evaluates whether engine speed 312 is greater than break-in engine speed threshold 314, and provides an output of either true or false to an input of logical AND operator 309. Machine total fueling 306 may be a value indicating the total fueling that is provided to an engine, such as engine 102 of engine system 100 or another engine or system, at a given operating point or over a given operating period. Break-in engine speed threshold 314 may be a predetermined value established to set a minimum engine speed below which the engine is not considered to be operating in a green engine break-in mode.

Logical AND operator 309 provides a logical true output to the third input of selection operator 310 in accordance with the evaluations output by operators 307 and 313. When both operators 307 and 313 evaluate true, logical AND operator 309 outputs true and selection operator 310 is controlled to provide the value at its first output as an updated value of green engine break-in duty cycle time 302. Under these logical conditions the updated value of green engine break-in duty cycle time 302 will be an incremented value since both engine speed 312 and machine total fueling 306 are above their respective thresholds.

When both operator 307 and operator 313 evaluate true, logical AND operator 309 outputs true and selection operator 310 is controlled to output the value received at its first input as an updated value of green engine break-in duty cycle time 302. Under these logical conditions the updated value of green engine break-in duty cycle time 302 will be an incremented value since both engine speed 312 and machine total fueling 306 are above their respective thresholds.

When either operator 307 and 313 evaluates false, logical AND operator 309 outputs false and selection operator 310 is controlled to output the value received at its second input as an updated value of green engine break-in duty cycle time 302. Under these logical conditions the updated value of green engine break-in duty cycle time 302 will remain at its current value since one or both engine speed 312 and machine total fueling 306 are below their respective thresholds.

Figure 4:
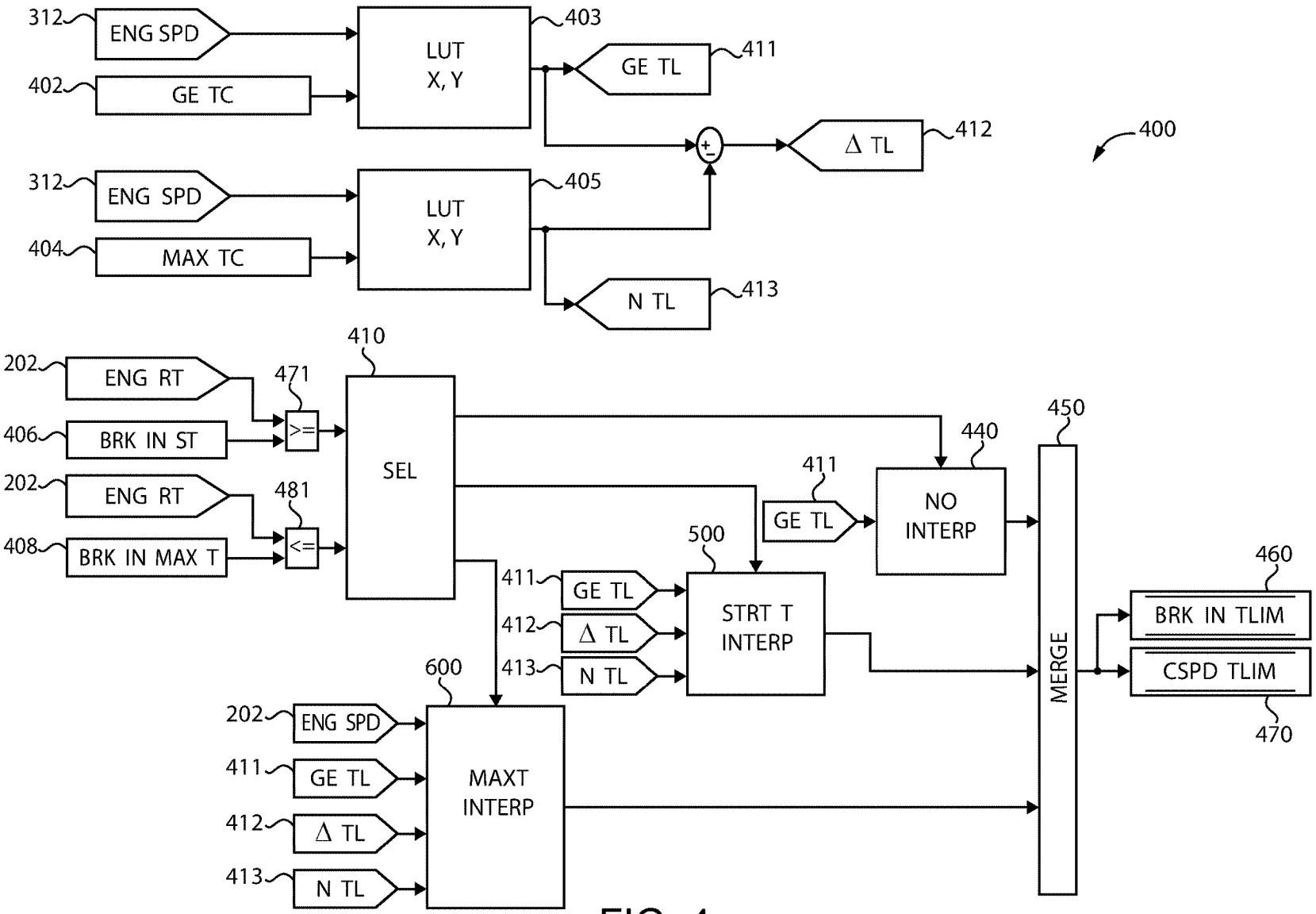
FIG. 4 is a schematic diagram illustrating certain aspects of example controls which may be implemented in and executed by one or more components of an electronic control system for an engine system.

With reference to FIG. 4, there are illustrated certain aspects of example controls 400 which may be implemented in and executed by one or more components of an ECS in operative communication with an engine, such as controller 130 and/or other ECS components and systems. In one respect, controls 400 are configured and operable to determine a green engine operation torque limit 411, a normal operation torque limit 413, and a torque limit delta 412. Lookup table 403 receives as input engine speed 312 and green engine torque curve 402 and, in response to the received inputs determines and outputs green engine operation torque limit 411. Lookup table 405 receives as input engine speed 312 and maximum torque curve 404 and, in response to the received inputs determines and outputs normal operation torque limit 413. Torque limit delta 412 is determined as the difference between green engine operation torque limit 411 and normal operation torque limit 413, e.g., by subtracting normal operation torque limit 413 from green engine operation torque limit 411.

Green engine operation torque limit 411 is provided as an input to no interpolation controls 440. Additionally, green engine operation torque limit 411, a normal operation torque limit 413, and torque limit delta 412 are provided as inputs to start time interpolation controls 500 which are illustrated and described in connection with FIG. 5. Furthermore, green engine operation torque limit 411, a normal operation torque limit 413, torque limit delta 412, and engine run time 202 are provided as inputs to maximum time interpolation controls 600 which are illustrated and described in connection with FIG. 6.

In a further respect, controls 400 are configured and operable to determine and select among operation according to no interpolation controls 440, start time interpolation controls 500, and maximum time interpolation controls 600. Logical operator 471 receives as input engine run time 202 and break-in start time 406, evaluates whether engine run time 202 is greater than or equal to break-in start time 406, and provides a true or false output to selection operator 210. Break-in start time 406 may be a predetermined time after which it has been determined to be appropriate for an engine to operate a green engine break-in mode.

Logical operator 481 receives as input engine run time 202 and break-in maximum time 408, evaluates whether engine run time 202 is greater than or equal to break-in maximum time 408, and provides a true or false output to selection operator 210. Break-in maximum time 408 may be a predetermined time limit after which it has been determined to no longer be appropriate for an engine to operate a green engine break-in mode.

Logical selection operator 410 receives the values output by logical operator 471 and logical operator 481. If the value received by logical selection operator 410 from logical operator 471 is false, logical selection operator 410 selects operation of no interpolation controls 440, and does not select operation of start time interpolation controls 500 or of maximum time interpolation controls 600. If the value received by logical selection operator 410 from logical operator 471 is true and the value received by logical selection operator 410 from logical operator 481 is false, logical selection operator 410 selects operation of start time interpolation controls 500, and does not select operation of no interpolation controls 440 or of maximum time interpolation controls 600. If the value received by logical selection operator 410 from logical operator 471 is true and the value received by logical selection operator 410 from logical operator 481 is false, logical selection operator 410 selects operation of maximum time interpolation controls 600, and does not select operation of no interpolation controls 440 or of start time interpolation controls 500. Operator 450 receives the output of whichever of no interpolation controls 440, start time interpolation controls 500, and maximum time interpolation controls 600 is active and selects or determines from the received input, a break-in torque limit 460 and a torque limit at current speed 470.

Figure 5:
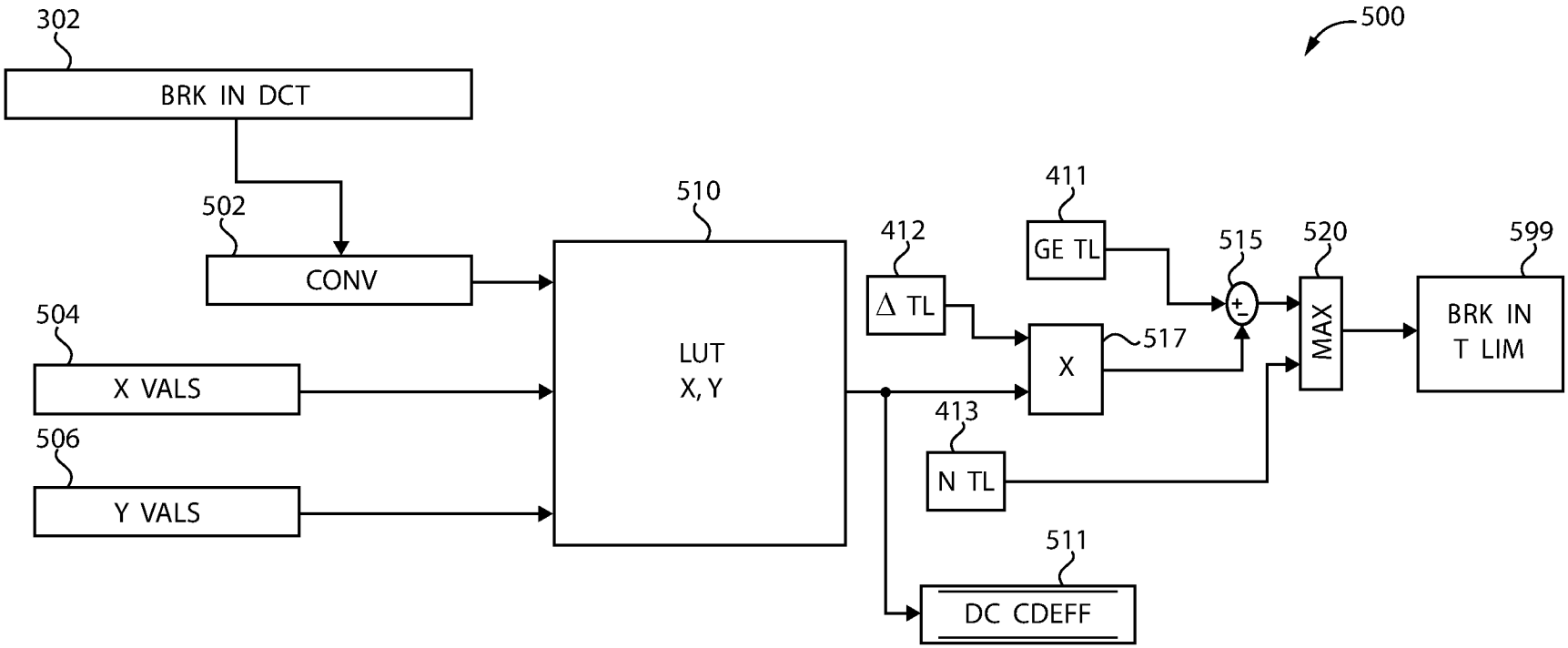
FIG. 5 is a schematic diagram illustrating certain aspects of example controls which may be implemented in and executed by one or more components of an electronic control system for an engine system.

With reference to FIG. 5, there are illustrated certain aspects of example controls 500 which may be implemented in and executed by one or more components of an ECS in operative communication with an engine, such as controller 130 and/or other ECS components and systems. Controls 500 are configured and operable to determine a break-in torque limit 599 which is utilized in controlling operation of an engine, such as engine 102 of engine system 100 or another engine. Controls 500 include a lookup table 510 including X-axis values 504 which provide a vector of green engine break-in duty cycle times and Y-axis values 506 which provide a corresponding vector of break-in ramp down coefficients. Green engine break-in duty cycle time 302 is provided to scaling and conversion logic 502 which provides a scaled and/or converted value of green engine break-in duty cycle time 302 to an input of lookup table 510 and which is utilized by lookup table 510 to determine and output a break-in duty cycle coefficient 511.

Operator 517 receives break-in duty cycle coefficient 511 and torque limit delta 412, multiplies the values of its received inputs, and outputs the resulting product to operator 515. Engine operation torque limit 411 is also provided to operator 515 which determines a difference between the inputs it receives, e.g., by subtracting the value of the output of operator 517 from engine operation torque limit 411. The output of operator 515 is provided to operator 520 which also receives normal operation torque limit 413 and which outputs the maximum of the two inputs which it receives as break-in torque limit 599 which is utilized in controlling an engine, such as engine 102 of engine system 100 or another engine.

It shall be appreciated that controls 500 are one example of controls configured to dynamically vary a break-in torque limit, such as green engine break-in torque limit 599, in response to break-in operation of the engine. It shall be further appreciated that lookup table 510 is one example of an interpolation component configured to vary or scale break-in duty cycle coefficient 511 as a function of green engine break-in duty cycle time 302. For example, break-in duty cycle coefficient 511 may be initiated at a value of zero, which is effective to provide engine operation torque limit 411 as green growth torque limit 599 with zero subtraction, and may finish at a value of one, which is effective to provide normal operation torque limit 411 as torque limit 599. In certain forms, lookup table 510 is configured to provide non-linear scaling of break-in duty cycle coefficient 511 such that torque limit 599 experiences a non-linear variation over at least certain ranges or over the entirety of green engine break-in duty cycle time 302.

Figure 6:
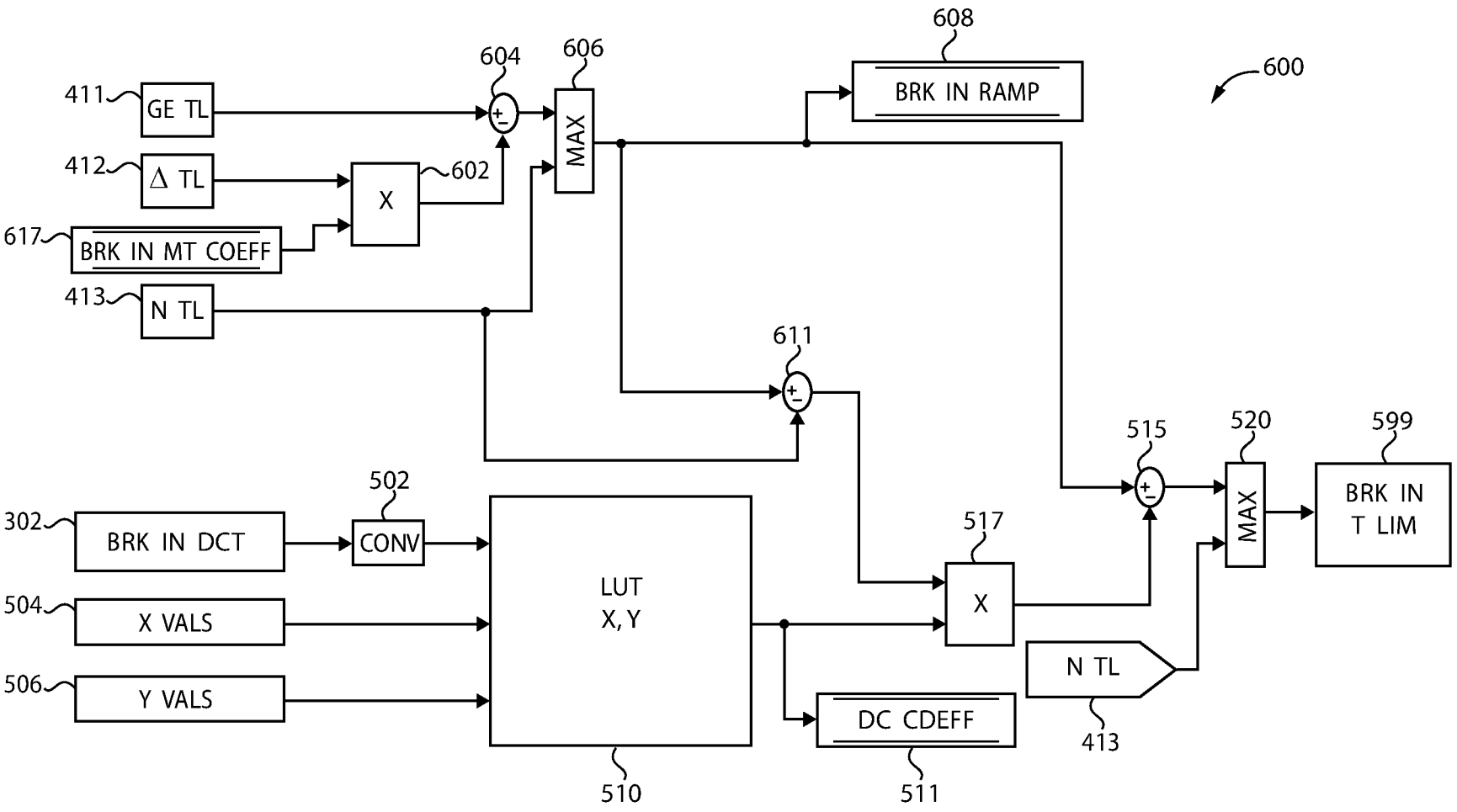
FIG. 6 is a schematic diagram illustrating certain aspects of example controls which may be implemented in and executed by one or more components of an electronic control system for an engine system.

With reference to FIG. 6, there are illustrated certain aspects of example controls 600 which may be implemented in and executed by one or more components of an ECS in operative communication with an engine, such as controller 130 and/or other ECS components and systems. Controls 600 are configured and operable provide an alternative determination of green engine break-in torque limit 599 which is utilized in controlling operation of an engine, such as engine 102 of engine system 100 or another engine. Controls 600 include a number of components which are the same as or substantially similar to components of controls 500 which are denoted with like reference numerals, including lookup table 510, X-axis values 504, Y-axis values 506, green engine break-in duty cycle time 302, scaling and conversion logic 502, break-in duty cycle coefficient 511, torque limit delta 412, operator 515, engine operation torque limit 411, operator 520, and normal operation torque limit 413. It shall be appreciated that the arrangement and function of these components are the same as or substantially similar to the description of controls 500 which applies, mutatis mutandis, to controls 600, Controls 600 also differ from controls 500 in certain respects. In one respect, operator 602 receives break-in maximum time duty cycle coefficient 617 and torque limit delta 412, multiplies the values of its received inputs, and outputs the resulting product to operator 604. Engine operation torque limit 411 is also provided to operator 604 which determines a difference between the inputs it receives, e.g., by subtracting the value of the output of operator 602 from engine operation torque limit 411. The output of operator 604 is provided to operator 606 which also receives normal operation torque limit 413 and which outputs the maximum of the two inputs which it receives as break-in final ramp down 608 which, in turn, is provided as an input to operator 515. In a further respect, break-in final ramp down 608 and normal operation torque limit 413 are provided as inputs to operator 611 which determines a difference between the inputs it receives, e.g., by subtracting the value of normal operation torque limit 413 from break-in final ramp down 608. The output of operator 611 is, in turn, provided as an input to operator 517.

It shall be appreciated that controls 600 are one example of controls configured to dynamically vary a break-in torque limit, such as break-in torque limit 599. It shall be further appreciated that the variation from controls 500 provided by controls 600 is effective to provide a final ramp down of variation of break-in torque limit 599 which differs from the variation of break-in torque limit 599 provided by controls 500. It shall also be appreciated that controls 600 are one example of controls which are effective to ramp-down to an end of break-in operation and which provide a soft ramp-down or soft-exit from green engine break-in operation.

A number of example embodiments shall now be further described. A first example embodiment is a method of operating an engine control system, the method comprising:

evaluating whether to operate an engine in a green engine break-in mode; and in the green engine break-in mode: determining a break-in torque limit for the engine, dynamically varying the break-in torque limit in response to break-in operation of the engine, and controlling the engine using the dynamically varied break-in torque limit.

A second example embodiment is a method including the features of the first example embodiment, wherein the act evaluating whether to operate the engine in the green engine break-in mode comprises providing a predetermined threshold corresponding to an engine run time.

A third example embodiment is a method including the features of the second example embodiment, wherein the engine operates in a first non-break-in mode when the engine operates below the predetermined threshold.

A fourth example embodiment is a method including the features of the second example embodiment, wherein the engine operates in the green engine break-in mode when the engine operates above the predetermined threshold.

A fifth example embodiment is a method including the features of the fourth example embodiment, wherein the engine operates in a second non-break-in mode after the engine has been running in the green engine break-in mode longer than a predetermined time for operating in the green engine break-in mode.

A sixth example embodiment is a method including the features of the fifth example embodiment, wherein the second non-break-in mode is effective to ramp-down to an end of break-in operation.

A seventh example embodiment is a method including the features of any of the first through sixth example embodiments, wherein the act of determining a break-in torque limit for the engine comprises calculating a green engine break-in torque limit using a non-break-in torque limit, and a green engine break-in torque limit.

An eighth example embodiment is a method including the features of the seventh example embodiment, wherein the act of calculating a green engine break-in torque limit comprises interpolating between the non-break-in torque limit and the green engine break-in torque limit.

A ninth example embodiment is a method including the features of the eighth example embodiment, wherein the interpolation is based upon a coefficient which varies with a duration of green engine break-in operation.

A tenth example embodiment is a method including the features of any of the first through sixth example embodiments, wherein the act of dynamically varying the break-in torque limit in response to break-in operation of the engine comprises: providing a green torque value and an actual torque value for the break-in torque limit when the engine is in the green engine break-in mode; determining a first parameter associated with an amount of time the engine has been running in the green engine break-in mode; determining a second parameter that is a calculation of a difference between a green torque value and actual torque of the engine in the green engine break-in mode; calculating a third parameter based on the determined first and second parameter; and dynamically varying the break-in torque limit based on a difference between the green torque value and the third parameter.

An eleventh example embodiment is a system comprising: an electronic control system configured to control operation of an engine by: evaluating whether to operate the engine in a green engine break-in mode; and in the green engine break-in mode: determining a break-in torque limit for the engine, dynamically varying the break-in torque limit in response to break-in operation of the engine, and controlling operation of the engine using the dynamically varied break-in torque limit.

A twelfth example embodiment is a system including the features of the eleventh example embodiment, wherein the electronic control system is configured to evaluate whether to operate the engine in the green engine break-in mode comprises providing a predetermined threshold corresponding to an engine run time.

A thirteenth example embodiment is a system including the features of the twelfth example embodiment, wherein the electronic control system is configured to operate the engine in a first non-break-in mode when the engine operates below the predetermined threshold.

A fourteenth example embodiment is a system including the features of the thirteenth example embodiment, wherein the electronic control system is configured to operate the engine in the green engine break-in mode when the engine operates above the predetermined threshold.

A fifteenth example embodiment is a system including the features of the fourteenth example embodiment, wherein the electronic control system is configured to operate the engine in a second non-break-in mode after the engine has been running in the green engine break-in mode longer than a predetermined time for operating in the green engine break-in mode.

A sixteenth example embodiment is a system including the features of the fifteenth example embodiment, wherein the second non-break-in mode is effective to ramp-down to an end of break-in operation.

A seventeenth example embodiment is a system including the features of any of the eleventh through sixteenth example embodiments, wherein the electronic control system is configured to determine a break-in torque limit for the engine comprises calculating a green engine break-in torque limit using a non-break-in torque limit, and a green engine break-in torque limit.

An eighteenth example embodiment is a system including the features of the seventeenth example embodiment, wherein the electronic control system is configured to calculate a green engine break-in torque limit comprises interpolating between the non-break-in torque limit and the green engine break-in torque limit.

A nineteenth example embodiment is a system including the features of the eighteenth example embodiment, wherein the interpolation is based upon a coefficient which varies with a duration of green engine break-in operation.

A twentieth example embodiment is a system including the features of any of the eleventh through sixteenth example embodiments, wherein the electronic control system is configured to dynamically vary the break-in torque limit in response to break-in operation of the engine by: providing a green torque value and an actual torque value for the break-in torque limit when the engine is in the green engine break-in mode; determining a first parameter associated with an amount of time the engine has been running in the green engine break-in mode; determining a second parameter that is a calculation of a difference between a green torque value and actual torque of the engine in the green engine break-in mode; calculating a third parameter based on the determined first and second parameter; and dynamically varying the break-in torque limit based on a difference between the green torque value and the third parameter.

A twenty-first example embodiment is an apparatus comprising: a controller configured to control operation of an engine; and one or more non-transitory memory media configured to store instructions executable by the controller to: evaluate whether to operate the engine in a green engine break-in mode; and in the green engine break-in mode: determine a break-in torque limit for the engine, dynamically vary the break-in torque limit in response to break-in operation of the engine, and control operation of the engine using the dynamically varied break-in torque limit.

A twenty-second example embodiment is an apparatus including the features of the twenty-first example embodiment, wherein the instructions are executable by the controller to evaluate whether to operate the engine in the green engine break-in mode comprises providing a predetermined threshold corresponding to an engine run time.

A twenty-third example embodiment is an apparatus including the features of the twenty-second example embodiment, wherein the instructions are executable by the controller to operate the engine in a first non-break-in mode when the engine operates below the predetermined threshold.

A twenty-fourth example embodiment is an apparatus including the features of the twenty-third example embodiment, wherein the instructions are executable by the controller to operate the engine in the green engine break-in mode when the engine operates above the predetermined threshold.

A twenty-fifth example embodiment is an apparatus including the features of the twenty-fourth example embodiment, wherein the instructions are executable by the controller to operate the engine in a second non-break-in mode after the engine has been running in the green engine break-in mode longer than a predetermined time for operating in the green engine break-in mode.

A twenty-sixth example embodiment is an apparatus including the features of the twenty-fifth example embodiment, wherein the second non-break-in mode is effective to ramp-down to an end of break-in operation.

A twenty-seventh example embodiment is an apparatus including the features of any of the twenty-first through twenty-sixth example embodiments, wherein the instructions are executable by the controller to determine a break-in torque limit for the engine comprises calculating a green engine break-in torque limit using a non-break-in torque limit, and a green engine break-in torque limit.

A twenty-eighth example embodiment is an apparatus including the features of the twenty-seventh example embodiment, wherein the instructions are executable by the controller to calculate a green engine break-in torque limit comprises interpolating between the non-break-in torque limit and the green engine break-in torque limit.

A twenty-ninth example embodiment is an apparatus including the features of the twenty-eighth example embodiment, wherein the interpolation is based upon a coefficient which varies with a duration of green engine break-in operation.

A thirtieth example embodiment is an apparatus including the features of any of the twenty-first through twenty-sixth example embodiments, wherein the instructions are executable by the controller to dynamically vary the break-in torque limit in response to break-in operation of the engine by: providing a green torque value and an actual torque value for the break-in torque limit when the engine is in the green engine break-in mode; determining a first parameter associated with an amount of time the engine has been running in the green engine break-in mode; determining a second parameter that is a calculation of a difference between a green torque value and actual torque of the engine in the green engine break-in mode; calculating a third parameter based on the determined first and second parameter; and dynamically varying the break-in torque limit based on a difference between the green torque value and the third parameter.

While illustrative embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A method of operating an engine control system, the method comprising:

evaluating whether to operate an engine in a green engine break-in mode;

in response to the evaluating selectably controlling the engine in one of the green break-in mode and a non-green break-in mode; and in the green engine break-in mode:

determining a break-in torque limit for the engine, dynamically varying the break-in torque limit in response to break-in operation of the engine, and controlling the engine using the dynamically varied break-in torque limit.

2. The method of claim 1 wherein the evaluating whether to operate the engine in the green engine break-in mode comprises providing a predetermined threshold corresponding to an engine run time.

3. The method of claim 2 wherein the engine operates in a first non-break-in mode when the engine operates below the predetermined threshold.

4. The method of claim 2 wherein the engine operates in the green engine break-in mode when the engine operates above the predetermined threshold.

5. The method of claim 4 wherein the engine operates in a second non-break-in mode after the engine has been running in the green engine break-in mode longer than a predetermined time for operating in the green engine break-in mode.

6. The method of claim 5 wherein the second non-break-in mode is effective to ramp-down to an end of break-in operation.

7. The method of claim 1 wherein the act of determining a break-in torque limit for the engine comprises calculating a green engine break-in torque limit using a non-break-in torque limit, and a green engine break-in torque limit.

8. The method of claim 7 wherein the act of calculating a green engine break-in torque limit comprises interpolating between the non-break-in torque limit and the green engine break-in torque limit.

9. The method of claim 8 wherein the interpolation is based upon a coefficient which varies with a duration of green engine break-in operation.

10. The method of claim 1 wherein the act of dynamically varying the break-in torque limit in response to break-in operation of the engine comprises:

providing a green torque value and an actual torque value for the break-in torque limit when the engine is in the green engine break-in mode;

determining a first parameter associated with an amount of time the engine has been running in the green engine break-in mode;

determining a second parameter that is a calculation of a difference between a green torque value and actual torque of the engine in the green engine break-in mode;

calculating a third parameter based on the determined first and second parameter; and dynamically varying the break-in torque limit based on a difference between the green torque value and the third parameter.

11. A system comprising:

an electronic control system configured to control operation of an engine by:

evaluating whether to operate the engine in a green engine break-in mode; and in the green engine break-in mode:

determining a break-in torque limit for the engine, dynamically varying the break-in torque limit in response to break-in operation of the engine, and controlling operation of the engine using the dynamically varied break-in torque limit.

12. The system of claim 11 wherein the electronic control system is configured to evaluate whether to operate the engine in the green engine break-in mode comprises providing a predetermined threshold corresponding to an engine run time.

13. The system of claim 12 wherein the electronic control system is configured to operate the engine in a first non-break-in mode when the engine operates below the predetermined threshold.

14. The system of claim 13 wherein the electronic control system is configured to operate the engine in the green engine break-in mode when the engine operates above the predetermined threshold.

15. The system of claim 14 wherein the electronic control system is configured to operate the engine in a second non-break-in mode after the engine has been running in the green engine break-in mode longer than a predetermined time for operating in the green engine break-in mode.

16. The system of claim 15 wherein the second non-break-in mode is effective to ramp-down to an end of break-in operation.

17. The system of claim 11 wherein the electronic control system is configured to determine a break-in torque limit for the engine comprises calculating a green engine break-in torque limit using a non-break-in torque limit, and a green engine break-in torque limit.

18. The system of claim 17 wherein the electronic control system is configured to calculate a green engine break-in torque limit comprises interpolating between the non-break-in torque limit and the green engine break-in torque limit.

19. The system of claim 18 wherein the interpolation is based upon a coefficient which varies with a duration of green engine break-in operation.

20. The system of claim 11 wherein the electronic control system is configured to dynamically vary the break-in torque limit in response to break-in operation of the engine by:

providing a green torque value and an actual torque value for the break-in torque limit when the engine is in the green engine break-in mode;

determining a first parameter associated with an amount of time the engine has been running in the green engine break-in mode;

determining a second parameter that is a calculation of a difference between a green torque value and actual torque of the engine in the green engine break-in mode;

calculating a third parameter based on the determined first and second parameter; and dynamically varying the break-in torque limit based on a difference between the green torque value and the third parameter.

21. An apparatus comprising:

a controller configured to control operation of an engine; and one or more non-transitory memory media configured to store instructions executable by the controller to:

evaluate whether to operate the engine in a green engine break-in mode; and in the green engine break-in mode:

determine a break-in torque limit for the engine, dynamically vary the break-in torque limit in response to break-in operation of the engine, and control operation of the engine using the dynamically varied break-in torque limit.

22. The apparatus of claim 21 wherein the instructions are executable by the controller to evaluate whether to operate the engine in the green engine break-in mode comprises providing a predetermined threshold corresponding to an engine run time.

23. The apparatus of claim 22 wherein the instructions are executable by the controller to operate the engine in a first non-break-in mode when the engine operates below the predetermined threshold.

24. The apparatus of claim 23 wherein the instructions are executable by the controller to operate the engine in the green engine break-in mode when the engine operates above the predetermined threshold.

25. The apparatus of claim 24 wherein the instructions are executable by the controller to operate the engine in a second non-break-in mode after the engine has been running in the green engine break-in mode longer than a predetermined time for operating in the green engine break-in mode.

26. The apparatus of claim 25 wherein the second non-break-in mode is effective to ramp-down to an end of break-in operation.

27. The apparatus of claim 21 wherein the instructions are executable by the controller to determine a break-in torque limit for the engine comprises calculating a green engine break-in torque limit using a non-break-in torque limit, and a green engine break-in torque limit.

28. The apparatus of claim 27 wherein the instructions are executable by the controller to calculate a green engine break-in torque limit comprises interpolating between the non-break-in torque limit and the green engine break-in torque limit.

29. The apparatus of claim 28 wherein the interpolation is based upon a coefficient which varies with a duration of green engine break-in operation.

30. The apparatus of claim 21 wherein the instructions are executable by the controller to dynamically vary the break-in torque limit in response to break-in operation of the engine by:

providing a green torque value and an actual torque value for the break-in torque limit when the engine is in the green engine break-in mode;

determining a first parameter associated with an amount of time the engine has been running in the green engine break-in mode;

determining a second parameter that is a calculation of a difference between a green torque value and actual torque of the engine in the green engine break-in mode;

calculating a third parameter based on the determined first and second parameter; and dynamically varying the break-in torque limit based on a difference between the green torque value and the third parameter.

* * * * *